United States Patent [19]

Robinson

[11] 4,237,980

[45] Dec. 9, 1980

[54] CHECK VALVE FOR FLUID-PRODUCING WELLS

[75] Inventor: Robert G. Robinson, Edmonton, Canada

[73] Assignee: R & C Machine Devon Ltd., Edmonton, Canada

[21] Appl. No.: 20,819

[22] Filed: Mar. 15, 1979

[51] Int. Cl.[3] ..... E21B 34/08

[52] U.S. Cl. ..... 166/317; 166/322; 166/324; 166/325; 137/533.21

[58] Field of Search ..... 166/317, 322, 324, 325; 135/533.21, 68

[56] References Cited

U.S. PATENT DOCUMENTS

| | | | |
|---|---|---|---|
| 1,592,988 | 7/1926 | Morse | 137/533.21 |
| 1,754,975 | 4/1930 | Andersen | 137/533.21 |
| 1,873,735 | 8/1932 | Bowman et al. | 166/317 |
| 2,061,480 | 11/1936 | Pigott | 137/533.21 |
| 2,071,639 | 2/1937 | Long | 166/325 |
| 2,994,280 | 8/1961 | Daffin | 166/325 |
| 3,994,338 | 11/1976 | Hix | 166/317 |

*Primary Examiner*—William F. Pate, III
*Attorney, Agent, or Firm*—Max L. Wymore

[57] ABSTRACT

A check valve is provided for use in the tubing string of a fluid producing well. The check valve is removably seated within the restricted diameter of a seating nipple in the tubing string. Resilient holddown means at the base of the valve are provided for this purpose. The check valve comprises a hollow generally tubular body having a pierceable valve element positioned therein, the valve opens and closes in response to fluid pressures bearing thereon. To equalize the pressures above and below the valve the pierceable valve element may be ruptured by a conventional wireline spear, allowing the fluid to drain slowly through the valve.

2 Claims, 3 Drawing Figures

TO SURFACE 4
1
8
6
3
9
7
5
OIL POOL

CHECK VALVE FOR FLUID-PRODUCING WELLS

BACKGROUND OF THE INVENTION

The present invention relates to a check valve for use in a fluid producing well. More particularly the invention relates to a retrievable check valve which provides simple means for equalization of pressures above and below the valve.

Check valves are commonly used within a string of tubing of a fluid producing well wherein a submersible pump is being used to move fluid to the surface. The pump is usually located at the fluid bearing formation, adjacent the foot of the string of tubing. Usually impellors within the pump are electrically driven to force the fluid upwardly. Thus, while the pump is in operation, a column of fluid extends the length of the tubing string above the pump. In the event of stopping the pump, this suspended column, if not restricted, would back flow through the pump. This back flow would reverse the impellors at high speed, thereby causing damage to the thrust bearings. Therefore a check valve is placed in the tubing string above the pump to regulate the back flow of fluid through the pump.

Many such check valves are in common use, the simplest of which is a ball-in-a-cage valve. Here a tubular cage is provided having a seat at its lower end. A ball within the cage seats on the seat and is dislodged in response to the upward flow of fluids. Back flow however is restricted as the ball becomes reseated. Such valves suffer the disadvantage known as "squirrel caging", wherein the gaseous nature of the fluid flow causes the ball to bounce around in the cage, causing damage to both the ball and cage, and ultimately resulting in a loss of effective seal.

Flapper check valves are also known in the art. According to this design, a horizontal flap in a tubular body is hinged to open and close in response to flow pressures bearing from above and below the valve. In the past, both the flapper and the ball-in-a-cage type valves have had the tubular body threaded into the tubing string, making the valves non-retrievable by design. Thus to replace or repair the valve, it was necessary to pull out the entire tubing string, a time-consuming and costly process.

A further type of check valve used in well strings is the dart-type valve. A dart is seated in the lower portion of a closed tubular body and is provided with an upper tubular shaft. A narrow upper neck portion of the tubular body guides the dart shaft as the dart is translated upwardly to allow flow past the valve. Valves of this type are generally subject to jamming problems, since considerable sand tends to lodge itself in the upper tubular body above the dart shaft, restricting the upward movement of the dart.

These previously described check valves commonly suffer the disadvantage of not providing simple means to equalize pressures above and below the valve. Once the valve has closed to restrict back flow of the fluid therethrough, it is desirable to allow the column of fluid suspended above the valve to drain slowly past the valve to thereby equalize pressures without damaging the thrust bearings. Otherwise, to remove the valve or pump, the tubing string, laden with the fluid column, must be pulled to the surface. In deep wells, the additional weight of the fluid column is considerable, making the pulling operation difficult.

Heretofore, to provide for equalization in check valves has been a complicated matter of providing bypass ducts which open and close either by surface control or in response to changing pressures bearing on the valve. For instance, in U.S. Pat. No. 2,994,280 to Daffin, there is disclosed a retrievable check valve of a ball-in-a-cage design which is provided with equalization means. Shear pins are used to hold an outer sleeve of the tubular body in place. An upward pull on the valve shears the pins, allowing the sleeve to translate upwardly, thereby aligning bypass ports of the sleeve and inner tubular body to allow fluid to flow therethrough.

SUMMARY OF THE PRESENT INVENTION

The present invention provides a check valve which seats in a seating nipple position above a submersible pump in the tubing string of a producing well.

The check valve is designed to be retrievable. It comprises a hollow, generally tubular body having conventional latching means at its upper end for engaging a wireline tool inserted in the string to remove it. The tubular body further comprises conventional resilient holddown means at its lower end, for anchoring the valve in the seating nipple, and conventional shoulder means between its ends, for preventing downward displacement of the body through the seating nipple.

The tubular body is flow through in design, having a longitudinal bore extending therethrough. The bore is preferably reduced in cross-section at its upper end and the body thus forms an inwardly projecting stop shoulder for a purpose to be explained. Spaced below this stop shoulder, the tubular body wall projects inwardly to form an annular valve seat. The portion of the body bore between the seat and the stop shoulder is termed the valve chamber.

A valve element is positioned within the valve chamber. The valve element is vertically moveable within the chamber. When seated by downwardly directed pressure onto the annular valve seat, the valve element prevents downward fluid flow through the bore. When unseated by pressure from below, a clearance between the outer rim of the valve body and the inner surface of the valve chamber wall permits upward flow around the valve element. The stop shoulder limits upward travel of the valve element.

The valve element comprises a generally tubular body having a transversely extending pierceable wall closing off or sealing its longitudinal bore. The cross-sectional area of that segment of the pierceable portion which is exposed or available to be pierced is substantially less than any cross-sectional area of the longitudinal bore of the tubular body. Thus, when the pierceable portion is pierced (as by a wireline spear), the drain opening so formed is relatively small and back flow through it is restricted, whereby the submersible pump is not damaged by such back flow.

Broadly stated, the invention is a check valve for controlling back flow in the tubing string of a fluid-producing well, said string have a submersible pump positioned at its lower end, said tubing string further incorporating a seating nipple above the submersible pump, said check valve comprising: a retrievable generally tubular body adapted to seat in the seating nipple and having a first longitudinal bore extending therethrough, said body forming an annular valve seat and a stop shoulder spaced above the valve seat, said valve seat and stop shoulder defining the ends of a chamber which is part of the bore; a generally tubular valve element having a second longitudinal bore and being disposed in the chamber, said valve member having a transversely extending wall which is pierceable by a wireline tool and which closes off the second bore against fluid flow therethrough, said valve element being operative to prevent fluid flow through the first bore when it seats on the valve seat, said valve element being operative to permit fluid flow through the first bore when the valve element is unseated, the cross-sectional area of the pierceable wall available to be pierced being substantially less than the cross-sectional area of the first bore, whereby, when the wall is pierced, only restricted flow is permitted therethrough so as to avoid damaging the submersible pump.

DESCRIPTION OF THE PREFERRED EMBODIMENT

With reference to the drawings, the check valve of the present invention is comprised of hollow generally tubular body 1 having a pierceable valve element 2 positioned therein. Restrictive element 2 is free to open and close in response to pressures bearing on it from below and above.

Figure 1:
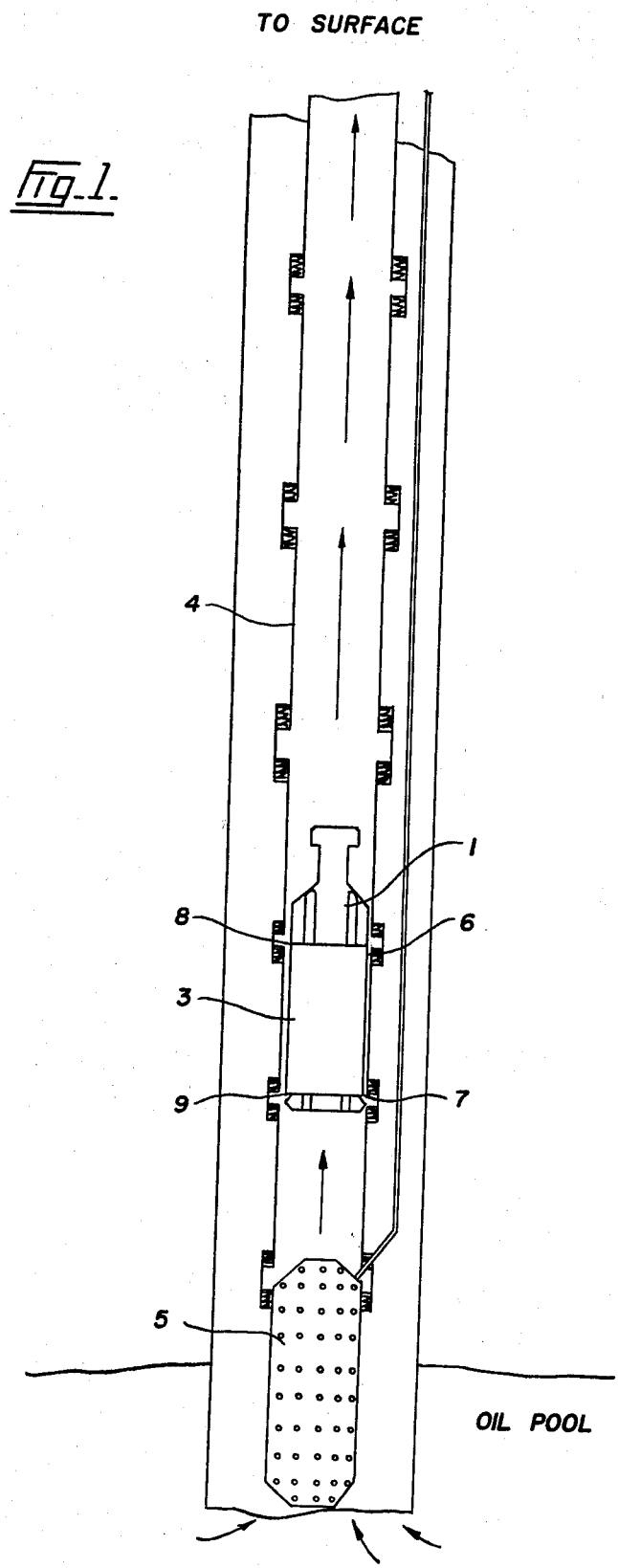
FIG. 1 is a sectional side view, illustrating the check valve seated within the tubing string of a fluid producing well.

The tubular body 1 is shown in FIG. 1 removeably seated in a conventional seating nipple 3 threaded into the tubing string 4. The seating nipple 3 is located one or more lengths of tubing above an electrical submersible pump 5. Leaving this amount of space between the check valve and the pump is desirable to limit large gas pockets from forming therebetween when the pump is stopped. Large gas pockets cause considerable problems in restarting the pumping operation.

Seating nipples are conventionally used in seating well tools within tubing strings by providing regions having smaller internal diameter than that of the tubing. Seating nipple 3 is threaded at its upper and lower ends 6 and 7 respectively, to be secured into the tubing string 4. The upper edge of the seating nipple provides an upper landing seat 8, on which is seated tubular body 1. The lower edge of the seating nipple provides a holddown shoulder 9 to restrict the upward displacement of the tubular body 1 under the normal upwardly directed pressures of fluids being pumped to the surface.

THE TUBULAR BODY

Figure 2:
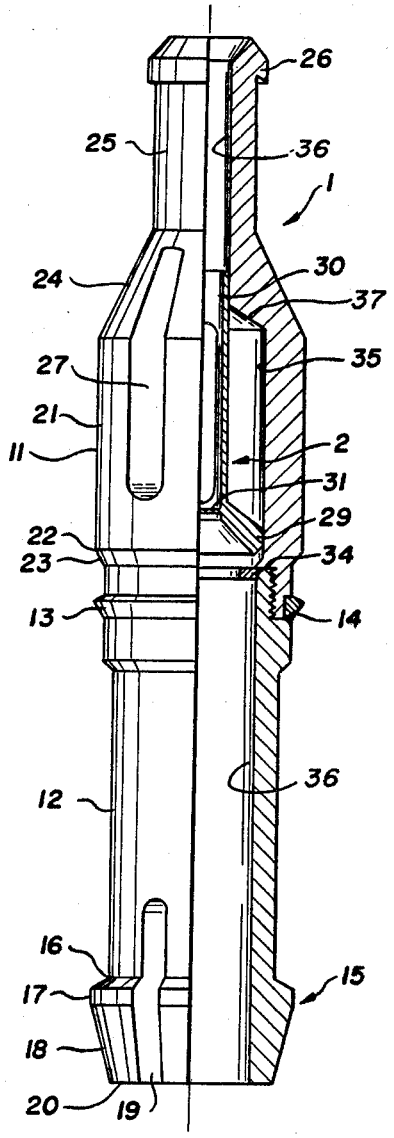
FIG. 2 is a perspective view of the check valve having a cut-away portion to illustrate the valve element in cross-section.

The hollow, generally tubular body 1, as seen in FIG. 2, comprises an upper body portion 11 and a lower body portion 12. A first longitudinal bore 36 extends through the body 1. The lower body portion 12 is threadably received by the upper body portion 11. An outwardly protruding lip 14 is provided at the upper end of the lower body portion 12. In order to seal the body portions 11 and 12 together, a packing ring 13 is carried by the lip 14 between the body portions 11 and 12.

The lower body portion 12 has an external diameter substantially equal to the internal diameter of the seating nipple 3 for close fitting relationship thereinto. The packing ring 13 has an external diameter slightly larger than the external diameter of the lower body portion. In this way, when the lower body portion 12 is fitted in seating nipple 3, the packing ring 13 bears on the inner wall of the seating nipple 3 to seal against leakage around the valve.

In order to removeably seat the tubular body in the seating nipple 3, resilient holddown means 15 are provided at the lower end of lower body portion 12. To form the resilient holddown means 15, the lower body portion 12 is flared outwardly at 16 to form a holddown collar 17. This collar 17 thus has an external diameter greater than the internal diameter of the seating nipple 3. The holddown collar 17 is tapered inwardly at 18 to facilitate the installation of the tubular body 1 into the seating nipple 3. The lower body portion 12 has at its lower end circumferentially spaced cut-out portions 19 extending a substantial distance upwardly past the holddown collar 17, to form a plurality of resilient flanges 20. The flanges 20 can be squeezed inwardly to allow the holddown collar 17 to be passed through the narrow internal diameter of the seating nipple. Once clear of the seating nipple however, the flanges 20 spring back to their original shape to restrict the upward displacement of the tubular body 1.

Downward displacement of the tubular body 1 past the seating nipple 3 is limited by the construction of the upper body portion 11. The upper body portion 11 has a widened intermediate portion 21 of external diameter greater than the internal diameter of the seating nipple 3 but not greater than the internal diameter of the tubing string 4. This intermediate portion 21 is tapered inwardly at 22 to form an upper landing shoulder 23. When the tubular body 1 is positioned in the seating nipple 3, this upper landing shoulder 23 seats on the upper landing seat 8 of the seating nipple 3. It will now be noted that the distance between the upper landing shoulder 23 and the holddown collar 17 of the tubular body 1 must be substantially equal to the distance between the upper landing seat 8 and the holddown shoulder 6 of the seating nipple 3, to allow a fitting relationship.

The upper end of the upper body portion 11 is tapered inwardly at 24 to provide a narrow latching neck portion 25. This latching neck 25 can be engaged by a wireline tool (not shown) to remove the tubular body 1 from the seating nipple 3. For this purpose, the uppermost end of the latching neck is beveled to form a latching head 26.

The valve element 2 is positioned in the upper body portion 11 of the tubular body and is moveable between a closed seated position and an open flow through position. In its seated position, the restrictive element 2 is seated on an annular valve seat 34 which is carried by the upper edge of the lower body portion 12. The intermediate portion 21 of the tubular body 1 is provided with at least one transverse port 27 along its length. In its open flow through position, the restrictive element 2, in its preferred embodiment, moves upwardly in the intermediate portion 21, clearing transverse port 27 and allowing fluid to move upwardly through the tubular body. A stop shoulder 37 is provided at the upper end of the intermediate portion 21. The stop shoulder 37 prevents upward displacement of the valve element 2. The valve seat 34 and stop shoulder 37 thus define the ends of a chamber 35 in which the valve element 2 moves.

In order to guide the valve element, in its preferred form, as it moves between the open and closed positions, the narrow latching neck portion is formed having both an internal and external diameter substantially smaller than the corresponding internal and external diameter of the intermediate portion.

THE VALVE ELEMENT

Figure 3:
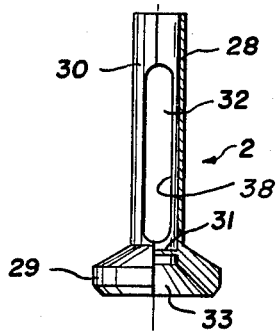
FIG. 3 is a perspective view of the valve element having a cut-away portion to illustrate the pierceable disc.

In its preferred form, the valve element 2 as seen in FIGS. 2 and 3, is a hollow plunger 28 having a second longitudinal bore 38. The plunger is sized for fitting relationship into the chamber 35 of the upper body portion 11. The plunger 28 has a lower plunger head 29 and an upper tubular guide shaft 30. The plunger head 29 is sized to fit loosely within the intermediate portion 21 while the guide shaft 30 is sized to fit loosely within the latching neck portion 25. The guide shaft 30 has at least one equalization window 32 formed along its length.

A transverse pierceable disc or wall 31 is formed across the lower end of the plunger 28, preferably intermediate the guide shaft 30 and the plunger head 29. In this manner, a fluid pocket 33 is formed beneath the pierceable disc 31 within the confines of the plunger head 29. As fluid is moving upwardly through the tubular body 1, the fluid in this fluid pocket 33 remains dead, thereby decreasing the wear on the pierceable disc. The cross-sectional area of the pierceable disc 31 is substantially less than the cross-sectional area of the first bore 36. By this provision, the disc 31, when pierced, permits a slow rate of flow therethrough to prevent damage to the submersible pump.

The plunger 28 is preferably machined as a single unit. In this way, the pierceable disc, being integral with the plunger, provides the increased strength necessary to support a column of fluid in the tubing string when the restrictive element 2 is in the seated position.

By providing a loose fit between the plunger 28 and the chamber 35 of the upper body portion 11, a clearance is provided therebetween. This clearance is sized to allow sand and shale particles to pass through the tubular body 1 without lodging therein or causing abrasive damage to either the tubular body 1 or the plunger 28.

Conceivably, the valve element could take the form of a hinged flap having a pierceable portion located therein.

OPERATION

The two piece tubular body 1, loaded with the valve element 2, the packing ring 13 and the ring seat 34, is threaded together. The body 1, thus assembled, is lowered into well tubing string 4 on a conventional wireline tool (not shown) which engages latching head 26. Upon reaching the restricted diameter of the seating nipple 3, the resilient flanges 20 are forced to bend inwardly to clear the seating nipple 3, springing outwardly again once the restriction is cleared. Once seated, the tubular body 1 cannot be displaced under the normal pressures of fluid flow.

To retrieve the tubular body 1, a conventional pulling tool (not shown) is latched onto latching head 26. An upward force from the surface is applied to dislodge the device.

As the submersible pump forces the fluids upwardly, fluid pressure bearing from below against the pierceable disc 31 force the hollow plunger 28 to move upwardly. This movement clears transverse port 27 to permit the fluid to communicate upwardly past the tubular body 1 to the surface. In this open flow through position, the plunger head 29 bears against the stop shoulder 37, thereby restricting the upward displacement of the plunger 28.

In the event that the pump is stopped, the downward pressure exerted on the pierceable disc by the column of fluids suspended above the device forces the plunger 28 to move to a closed seated position. The plunger is thereby seated on ring seat 34 to prevent an uncontrolled back flow through the device.

To equalize the pressures above and below the device, a spear (not shown) is run down the tubing string 4 on a wireline (not shown) to rupture the pierceable disc 31. The orifice thus formed in the disc 31 is sufficiently small so as to allow the column of fluid above the device to drain at speeds which do not damage the pump.

Once the pressures have been equalized the device may be retrieved with a pulling tool (not shown). The plunger 28 and packing ring 13 may be replaced and the device may be rerun back down the well.

The thickness of the disc 31 together with the number of packing rings 13 and ring seats 34 needed to seal the device against the pressures of operation are adjusted with the depth of the well.

The embodiments of the invention in which an exclusive property or privilege is claimed are defined as follows:

1. A check valve for controlling back flow in the tubing string of a fluid-producing well, said string having a submersible pump positioned at its lower end, said tubing string further incorporating a seating nipple above the submersible pump, said check valve comprising:

a retrievable generally tubular body adapted to seat in the seating nipple and having a first longitudinal bore extending therethrough, said body forming an annular valve seat and a stop shoulder spaced above the valve seat, said valve seat and stop shoulder defining the ends of a chamber which is part of the bore;

a generally tubular valve element having a second longitudinal bore and being disposed in the chamber, said valve member having a transversely extending wall which is pierceable by a wireline tool and which closes off the second bore against fluid flow therethrough, said valve element being operative to prevent fluid flow through the first bore when it seats on the valve seat, said valve element being operative to permit fluid flow through the first bore when the valve element is unseated, the cross-sectional area of the peirceable wall available to be pierced being substantially less than the cross-sectional area of the first bore, whereby, when the wall is pierced, only restricted flow is permitted therethrough so as to avoid damaging the submersible pump.

2. The check valve as set forth in claim 1 wherein:

the first bore is of reduced cross-section at its upper end and expanded cross-section throughout the chamber length;

the tubular body has one or more ports extending through the chamber wall above the valve seat;

said valve element comprises an upper tubular shaft and lower outwardly flared tubular head portion, said shaft sliding in the reduced cross-section of the first bore, said head portion sliding in the expanded cross-section of the chamber;

said pierceable wall extending across the second bore at the junction of the shaft and head portion; and said head portion being inwardly spaced from the wall of the tubular body to define a clearance for fluid flow past said head portion.

* * * * *